US007692584B2

(12) United States Patent
Hauff

(10) Patent No.: US 7,692,584 B2
(45) Date of Patent: Apr. 6, 2010

(54) ANTENNA SYSTEM DRIVEN BY INTELLIGENT COMPONENTS COMMUNICATING VIA DATA-BUS, AND METHOD AND COMPUTER PROGRAM THEREFORE

(75) Inventor: Christian Hauff, Salem (DE)

(73) Assignee: ND Satcom GmbH, Immenstaad (DE)

( * ) Notice: Subject to any disclaimer, the term of this patent is extended or adjusted under 35 U.S.C. 154(b) by 79 days.

(21) Appl. No.: 11/700,143

(22) Filed: Jan. 31, 2007

(65) Prior Publication Data

US 2008/0180337 A1 Jul. 31, 2008

(51) Int. Cl.
*H01Q 3/00* (2006.01)

(52) U.S. Cl. ..... 342/359

(58) Field of Classification Search ..... 342/357.07, 342/359–361; 701/207, 301, 29, 33
See application file for complete search history.

(56) References Cited

U.S. PATENT DOCUMENTS

| | | | | |
|---|---|---|---|---|
| 3,681,583 | A * | 8/1972 | Kubo et al. | 701/30 |
| 4,030,099 | A * | 6/1977 | Valenti et al. | 342/426 |
| 4,707,699 | A | 11/1987 | Toellner et al. | |
| 4,779,097 | A | 10/1988 | Morchin | |
| 5,205,518 | A * | 4/1993 | Stetson, Jr. | 244/165 |
| 5,259,577 | A * | 11/1993 | Achkar et al. | 244/164 |
| 5,818,385 | A * | 10/1998 | Bartholomew | 342/372 |
| 6,263,264 | B1 * | 7/2001 | Herman et al. | 701/13 |
| 6,317,688 | B1 * | 11/2001 | Bruckner et al. | 701/213 |
| 7,009,557 | B2 * | 3/2006 | Kirchofer et al. | 342/359 |
| 2002/0050944 | A1 * | 5/2002 | Sheynblat et al. | 342/357.06 |
| 2003/0149512 | A1 * | 8/2003 | Hrovat et al. | 701/1 |
| 2003/0176970 | A1 * | 9/2003 | Lin | 701/214 |
| 2004/0006424 | A1 * | 1/2004 | Joyce et al. | 701/207 |
| 2004/0217902 | A1 * | 11/2004 | Kim | 342/368 |
| 2005/0030228 | A1 * | 2/2005 | Judd | 342/383 |
| 2005/0119783 | A1 * | 6/2005 | Brisson et al. | 700/186 |
| 2005/0221759 | A1 * | 10/2005 | Spadafora et al. | 455/41.2 |
| 2006/0071849 | A1 * | 4/2006 | Howle et al. | 342/357.08 |
| 2007/0096977 | A1 * | 5/2007 | Lillo et al. | 342/357.02 |

FOREIGN PATENT DOCUMENTS

| | | |
|---|---|---|
| EP | 0 540 125 | 5/1993 |
| WO | 00/10224 | 2/2000 |
| WO | 2004/021507 | 3/2004 |

* cited by examiner

*Primary Examiner*—Thomas H Tarcza
*Assistant Examiner*—Nga X Nguyen
(74) *Attorney, Agent, or Firm*—Squire, Sanders & Dempsey, L.L.P.

(57) ABSTRACT

It is disclosed an antenna system drivable in at least one degree of freedom, comprising a target value provider configured to provide at least one target value, a data-bus configured to relay the at least one target value, at least one sensor unit configured to provide a current position in the at least one degree of freedom via the data-bus to the target value provider, and at least one antenna drive unit configured to drive the drivable antenna in the at least one degree of freedom according to the at least one target value.

3 Claims, 3 Drawing Sheets

ANTENNA SYSTEM DRIVEN BY INTELLIGENT COMPONENTS COMMUNICATING VIA DATA-BUS, AND METHOD AND COMPUTER PROGRAM THEREFORE

FIELD OF THE INVENTION

The present invention relates to an antenna system drivable in at least one degree of freedom, and a method and a computer program for the antenna system.

BACKGROUND

Hitherto, various antennae have been provided for a variety of applications, for example fixed (e.g. communication base stations), movable (e.g. on cars, airplanes or ships) or portable applications on the sending and/or receiving side. In many practical cases, hybrid applications emerge, e.g. when a fixed base station transmits and/or receives signals to and/or from a portable device.

For the purpose of the present invention to be described herein below, it should be noted that an antenna may be any device, unit or means capable of sending, receiving and/or transceiving polarized and/or unpolarized electromagnetic waves of any frequency or frequency range, or any spectrum, by means of any suitable technology e.g. based on electromagnetic induction; the antenna may be of any suitable structure, e.g. parabolic, planar, or array-like, and may use any suitable technology for detecting and/or dispatching electromagnetic waves;

a degree of freedom (DOF) refers to any rotary and/or translatory movement axis in a three-dimensional space; although in the following an example is given of an antenna system with an antenna having 3 rotary DOFs for descriptive purposes, the present invention is not restricted thereto; any antenna having at least one DOF being rotary or translatory may be employed;

method steps likely to be implemented as software code portions and being run using a processor are software code independent and can be specified using any known or future developed programming language as long as the functionality defined by the method steps is preserved;

generally, any method step is suitable to be implemented as software or by hardware without changing the idea of the present invention in terms of the functionality implemented;

method steps and/or devices, units or means likely to be implemented as hardware components at an antenna system are hardware independent and can be implemented using any known or future developed hardware technology or any hybrids of these, such as MOS (Metal Oxide Semiconductor), CMOS (Complementary MOS), BiMOS (Bipolar MOS), BiCMOS (Bipolar CMOS), ECL (Emitter Coupled Logic), TTL (Transistor-Transistor Logic), etc., using for example ASIC (Application Specific IC (Integrated Circuit)) components, FPGA (Field-programmable Gate Arrays) components, CPLD (Complex Programmable Logic Device) components or DSP (Digital Signal Processor) components;

devices, units or means (e.g. antennae) can be implemented as individual devices, units or means, but this does not exclude that they are implemented in a distributed fashion throughout an environment, as long as the functionality of the device, unit or means is preserved.

Recently, various approaches have been proposed for controlling drivable antennae for mobile applications, e.g. for establishing an Uplink/Downlink connection to the communication satellite.

In consideration of the above, it is an object of the present invention to provide an accordingly improved antenna system drivable in at least one degree of freedom, and a method and a computer program for the antenna system.

According to the present invention, in a first aspect, this object is for example achieved by an antenna system comprising:

a target value provider configured to provide at least one target value;

a data-bus configured to relay the at least one target value;

at least one sensor unit configured to provide a current position in the at least one degree of freedom via the data-bus to the target value provider, and at least one antenna drive unit configured to drive the drivable antenna in the at least one degree of freedom according to the at least one target value.

According to advantageous further refinements of the invention as defined under the above first aspect, the data-bus is constituted by a Controller Area Network bus;

the at least one antenna drive unit is constituted by a data-bus based motor system, including:

a transceiver configured to receive the target value relayed by the data-bus;

a positioning sensor configured to detect a current motor state based on one of the at least one degree of freedom; and a motor configured to drive the antenna system in the one of the at least one degree of freedom according to the target value received by the transceiver and the current motor state detected by the positioning sensor:

the data-bus is configured to broadcast the at least one target value; and the transceiver is configured to decide a relevance of the target value based on the at least one degree of freedom;

the antenna system further comprises:

a data-bus based inclination sensor for detecting current states of both a pitch degree of freedom and a roll degree of freedom and broadcasting the current states via the data-bus, and the target value provider is configured to calculate a target value of a first degree of freedom, a first one of the at least one antenna drive unit is configured to drive the antenna system in the first degree of freedom according to the current motor state detected by the positioning sensor and the calculated target value of the first degree of freedom, and a second or further one of the at least one antenna drive unit is configured to drive the antenna system in a second or further degree of freedom according to a second or further one of the at least one target value received by the transceiver and the current motor state detected by the positioning sensor.

According to the present invention, in a second aspect, this object is for example achieved by a method comprising:

providing at least one target value;

data-bus based relaying the at least one target value; and driving the drivable antenna in the at least one degree of freedom according to the at least one target value.

According to advantageous further refinements of the invention as defined under the above second aspect, the data-bus based relaying comprises:

broadcasting the at least one target value via the data-bus; and deciding a relevance of the target value based on the at least one degree of freedom.

According to the present invention, in a third aspect, this object is for example achieved by a computer program comprising:

providing at least one target value;

data-bus based relaying the at least one target value; and driving the drivable antenna in the at least one degree of freedom according to the at least one target value.

According to the present invention, in a fourth aspect, this object is for example achieved by an antenna system comprising:

means for providing at least one target value;

means for data-bus based relaying the at least one target value;

means for providing a current position in the at least one degree of freedom via the means for data-bus based relaying to the means for providing the at least one target value, and means for driving the drivable antenna in the at least one degree of freedom according to the at least one target value.

In this connection, it has to be pointed out that advantageously the present invention enables:

A simple and easy-to-use structure, since no converters and/or antenna control units are required.

A compact structure, since the data-bus requires less wiring.

An inexpensive implementation, since any converters and/or antenna control units can be omitted, and no high quality wiring for analogue signal transmission is required.

An efficient manner of communication between the target value provider and the sensors as well as the motors of the antenna system is provided.

BRIEF DESCRIPTION OF THE DRAWINGS

Aspects of the present invention are described herein below with reference to the accompanying drawings, in which.

DETAILED DESCRIPTION OF ASPECTS OF THE PRESENT INVENTION

Aspects of the present invention are described herein below by way of example with reference to the accompanying drawings.

For the purpose of the present invention to be described herein below, it should be noted that a data-bus may be any device, unit or means for interconnecting various distributed devices, units or means; in a particular example, to which the present invention is not to be restricted to, a CAN (Controller Area Network)-bus is used for descriptive purposes, but any other data-bus following the same principles, e.g. sophisticated CAN-bus derivatives CANopen, DeviceNET, CleANopen or SafetyBus p, or following similar principles may be applied; furthermore, the data-bus may have any suitable topology, e.g. linear, star-shaped, token-ring, etc.

Figure 1:
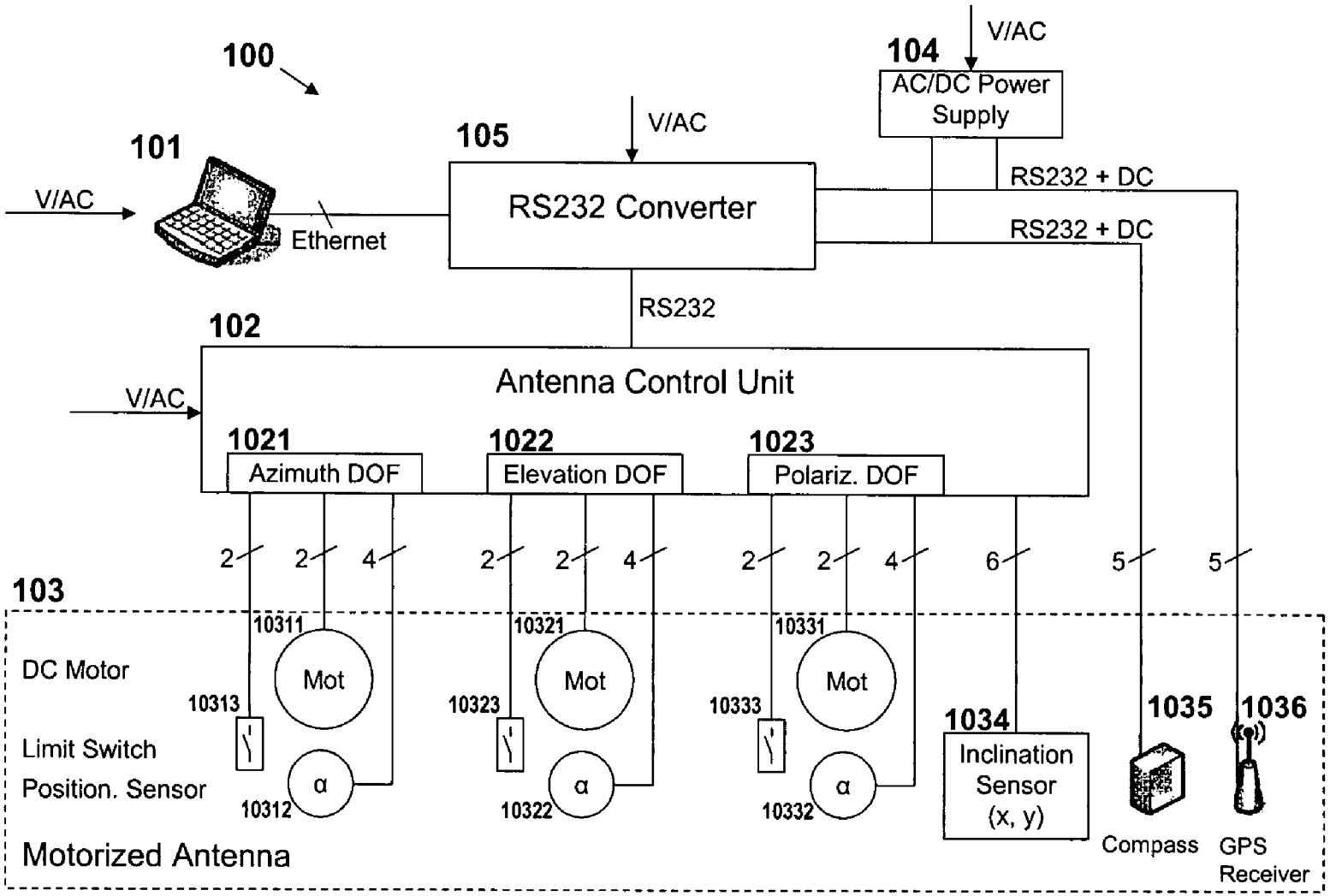
FIG. 1 shows the main functional components of the antenna system having the above-described structure.

As shown in FIG. 1, one approach suggests an antenna system 100 for satellite communication. The antenna system 100 consists of an antenna pointing system (APS) including a target value provider 101 and a RS232 (Recommended Standard 232) converter 105, an Antenna Control Unit (ACU) 102, an antenna 103 comprising DC motors 103*x*1 (wherein 103*x*1 represents reference signs 10311, 10321, and 10331) for driving the movement(s) of the antenna 103 as a result of a control effected by the APS 101, positioning sensors 103*x*2 (wherein 103*x*2 represents reference signs 10312, 10322, and 10332 for the ease of description) for detecting the current motor states and orientation sensors 1034, 1035, 1036 including an inclination sensor 1034, an optional compass 1035, and an optional GPS (Geographical Positioning System, including but not limited to the 'Global Positioning System') receiver 1036 for detecting the current geographical position and limit switches 103*x*3 (wherein 103*x*3 represents reference signs 10313, 10323, and 10333) for closed-loop controlling the DC motors 103*x*1. The antenna system 100 further comprises an AC/DC power supply 104 for AC/DC-converting an input AC voltage to a DC voltage. For the sake of completeness, arrows being marked with "V/AC" denote the AC voltage inputs into the target value provider 101, the ACU 102, the AC/DC power supply 104, and the RS232 converter 105. The AC voltage inputs may e.g. be a net voltage of 230V/AC in the European power net, 117 V/AC in the North American power net, or any suitable net voltage for power supply of the components involved.

The target value provider 101 is connected to the RS232 converter 105 via e.g. an Ethernet connection for sending and receiving digital data information. The RS232 converter 105 is connected with the ACU 102 via a RS232 interface (denoted between the functional blocks of the RS232 converter 105 and the ACU 102) for sending and receiving digital data information from the ACU 102. The RS232 converter 105 is also connected to the compass 1035 and the GPS receiver 1036 via a RS232 interface, wherein the DC voltage output of the AC/DC power supply 104 is combined (denoted by reference sign RS232+DC) with the RS232 interface between the RS232 converter 105 and the compass 1035 as well as the GPS receiver 1036.

The ACU 102 comprises an analogue interface 1021, 1022, 1023 and the APS 101 via 105 uses the analogue interface to control the movements of the DC motors 103*x*1 via the limit switches 103*x*3. Typically, the DC motors 103*x*1 are used for driving the antenna in the elevation, azimuth and polarization position. The ACU analogue interface 1021, 1022, 1023 for controlling the DC motors 103*x*1 comprises the settings "power on" and "power off", respectively, or "power" and "no power", respectively, and the control of the speed of movement of the DC motors 103*x*1.

The ACU 102 constitutes an analogue interface (not shown) for the inclination sensor 1034 in the same way as the above analogue interface 1021, 1022, 1023 for the azimuth, elevation, and polarization position. Current values of the azimuth, elevation, and polarization position of the DC motors 103*x*1 are detected by the positioning sensors 103*x*2 are sent as analogue signals to the analogue interface 1021, 1022, 1023 of the ACU 102, and, in the ACU 102, the above values are converted to digital data and are processed as an actual value for the control of the antenna movements in conjunction with the target values provided by the target value provider 101.

Connections between the analogue interface 1021, 1022, 1023 of the ACU 102 and the DC motors 103*x*1, the positioning sensors 103*x*2 and the limit switches 103*x*3 are implemented by conduits denoted by solid lines between the functional blocks of the ACU 102 and the antenna 103. Short lines intersecting the above solid lines and adjacent numbers denote the number of wires required for connection. As shown in FIG. 1, each DC motor 103*x*1 requires 2 wires, each positioning sensor 103*x*2 requires 4 wires, and the 3 limit switches 103*x*3 require 2 wires each for connection with the analogue interface 1021, 1022, 1023 of the ACU 102. The same applies to the inclination sensor 1034 which requires 6 wires for connection with the analogue interface (not shown) of the ACU 102.

A connection between the RS232 converter 105 and the compass 1035 via the combined connection RS232+DC requires 5 wires. The same applies to the GPS receiver 1036 which also requires 5 wires.

Therefore, the above approach has one or more of the following drawbacks:

Its structure is complicated:

Both the RS232 interface as well as the ACU are required for controlling movement of the antenna.

Its structure requires space-consuming wiring:

When connecting the RS232 interface as well as the ACU with the antenna, the wiring of each DOF control (azimuth, elevation and polarization) between the ACU and the antenna requires 12 wires (2 for the DC motor, 4 for the positioning sensor and 2 for the limit switch). Hence, wiring all three DOF controls requires 36 wires. Considering the wiring required for the orientation sensors (1034: 6 wires, 1035, 1036: 5 wires each), a total number of 52 wires is required for wiring the ACU and the RS232 converter with the antenna.

Its structure is expensive:

In order to ensure proper analogue signal transmission between the ACU/the converter and the antenna, high quality wiring has to be used. Therefore, the RS232 interface, the ACU and the high quality wiring render the overall system expensive.

Figure 2:
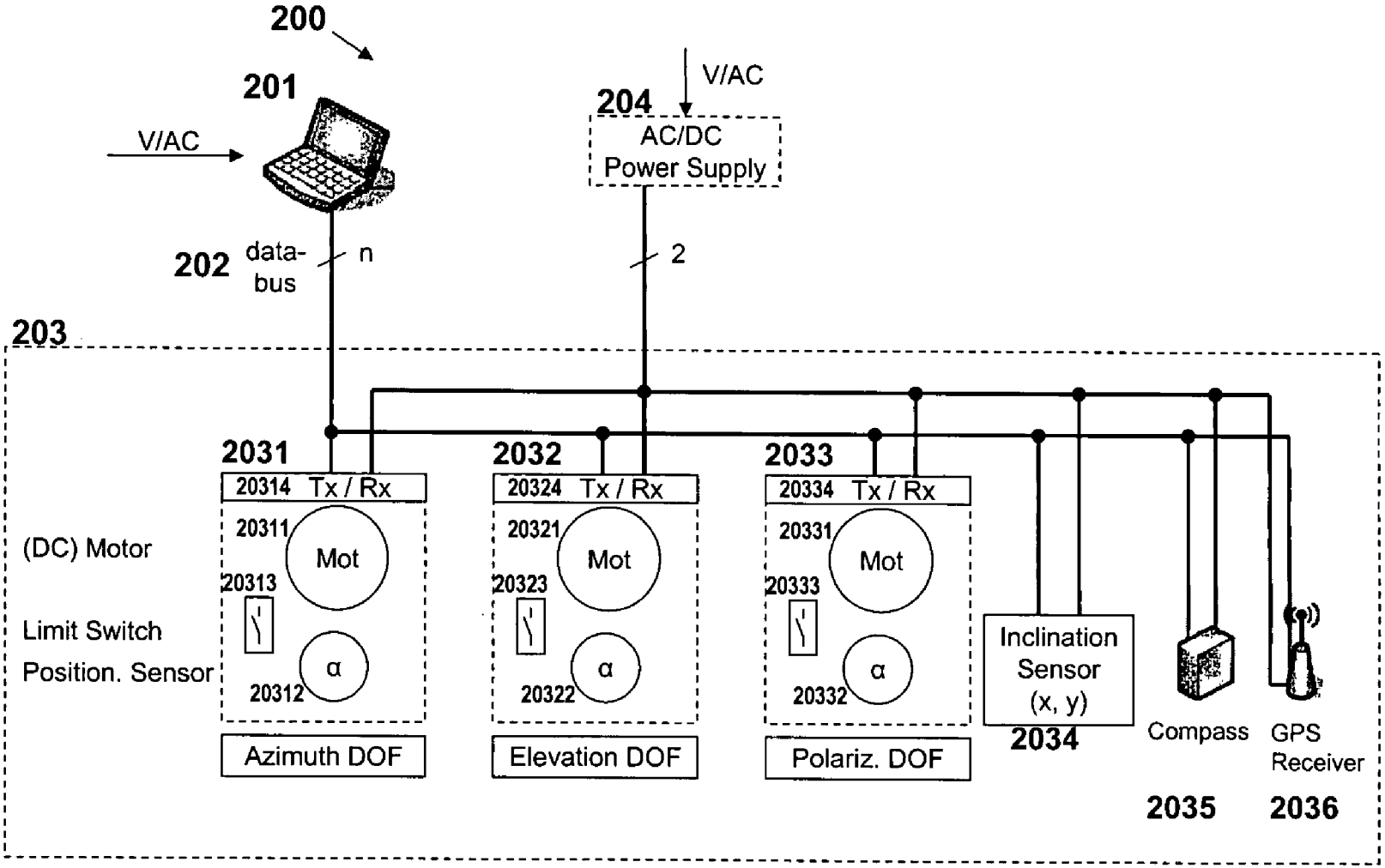
FIG. 2 shows main functional components of an antenna system according to the present invention.

FIG. 2 shows an antenna system 200 according to the present invention, comprising a target value provider 201 providing target values for at least one DOF, an antenna 203 and an optional AC/DC power supply 204 (indicated by the broken line functional block 204) for AC/DC-converting an AC input voltage in a DC voltage. The AC voltage input may e.g. be a net voltage of 230V/AC in the European power net, 117 V/AC in the North American power net, or any suitable net voltage for power supply of the components involved. The DC voltage output of the optional AC/DC power supply 204 may be supplied further e.g. by a conduit having 2 wires (as indicated by a short line beneath the functional block 204 intersecting the solid line beneath the functional block, and the adjacent number). In the present example, the target value provider 201 may also be referred to as the antenna pointing system APS.

Furthermore, the antenna 203 comprises antenna drive units 2031, 2032 and 2033, each for driving the antenna 203 in one DOF, a data-bus 202 for relaying the target values to the antenna drive units 2031, 2032, and 2023, an inclination sensor 2034, an optional compass 2035 and an optional GPS receiver 2036. The data-bus 202 may comprise any positive integer number n of wires (as indicated by a short line intersecting the solid line next to the caption "data-bus", and the adjacent letter n) depending e.g. on a bit-width of the values transmitted over the data-bus, and may reach from a simple two-wire data-bus to a complex n-wire data-bus.

Each one of the antenna drive units 2031, 2032 and 2033 comprises a (DC) motor **203*x*1 (wherein 203*x*1 represents reference signs 20311, 20321, and 20331 for ease of the description) for driving the antenna in one DOF, a positioning sensor 203*x*2 (wherein 203*x*2 represents reference signs 20312, 20322, and 20332) for detecting the current motor state in terms of the one DOF, a limit switch 203*x*3 (wherein 203*x*3 represents reference signs 20313, 20323, and 20333) for feed-back controlling the motor 203*x*1, and a transceiver 203*x*4 (wherein 203*x*4 represents reference signs 20314, 20324, and 20334) for sending and/or receiving the target values provided by the target value provider 201 and relayed by the data-bus 202. For the sake of completeness, arrows being marked with "V/AC" denote the AC voltage inputs into the target value provider 201 and the AC/DC power supply 204**.

It is to be noted that the motors **203*x*1 may be constituted either by DC motors or AC motors. In case of DC motors, the AC/DC power supply 204 may be provided for supplying a suitable DC voltage to the motors 203*x*1**.

Preferably, but not exclusively, the data-bus 202 is configured to broadcast the target value to all or substantially all devices, units or means connected to the data-bus 202. In addition, the transceivers **203*x*4 of the antenna drive units 2031, 2032 and 2033 are preferably each configured to decide a relevance of the broadcasted target value e.g. based on the relevance of the DOF assigned to the target value for the associated motor 203*x*1**.

Preferably, but not exclusively, the inclination sensor 2034 is configured to detect the state of a pitch DOF and the state of a roll DOF, and is configured to broadcast the pitch DOF state and the roll DOF state via the data-bus 202, wherein the states are designated e.g. to the target value provider 201. In this case, the target value provider 201 may be configured to receive the pitch DOF state and the roll DOF state via the data-bus 202, to calculate corresponding compensation DOF target values, which may include offset DOF values to reach a target DOF, and to broadcast the calculated DOF target values via the data-bus 202.

Further in this case, a first one of the antenna drive units 2031, 2032 and 2033 (e.g. 2032) may be configured to drive the antenna 203 in the elevation DOF according to a first one of the target values provided by the target value provider 201, the motor state detected by the positioning sensor 20322, and the current state of the DOF detected by the inclination sensor 2034. Also in this case, a second one of the antenna drive units 2031, 2032 and 2033 (e.g. 2033) may be configured to drive the antenna 203 in the polarization DOF according to a second one of the target values provided by the target value provider 201, the motor state detected by the positioning sensor 20332, and the current state of the DOF detected by the inclination sensor 2034.

As a particular example, to which the present invention is not to be restricted to, the CAN-bus technology may be used for constituting the data-bus 202, thus facilitating the communication between the APS 201 and e.g. the positioning sensors **203*x*2 and the motors 203*x*1, which are then e.g. customized CAN-bus sensor and motors. In this case, the data-bus 202** may comprise a conduit consisting of 2 wires.

As an alternative, each of the antenna drive units 2031, 2032 and 2033 may be constituted e.g. by a data-bus based motor (e.g. a CAN-bus based motor) integrally including the positioning sensor and the limit switch.

Figure 3:
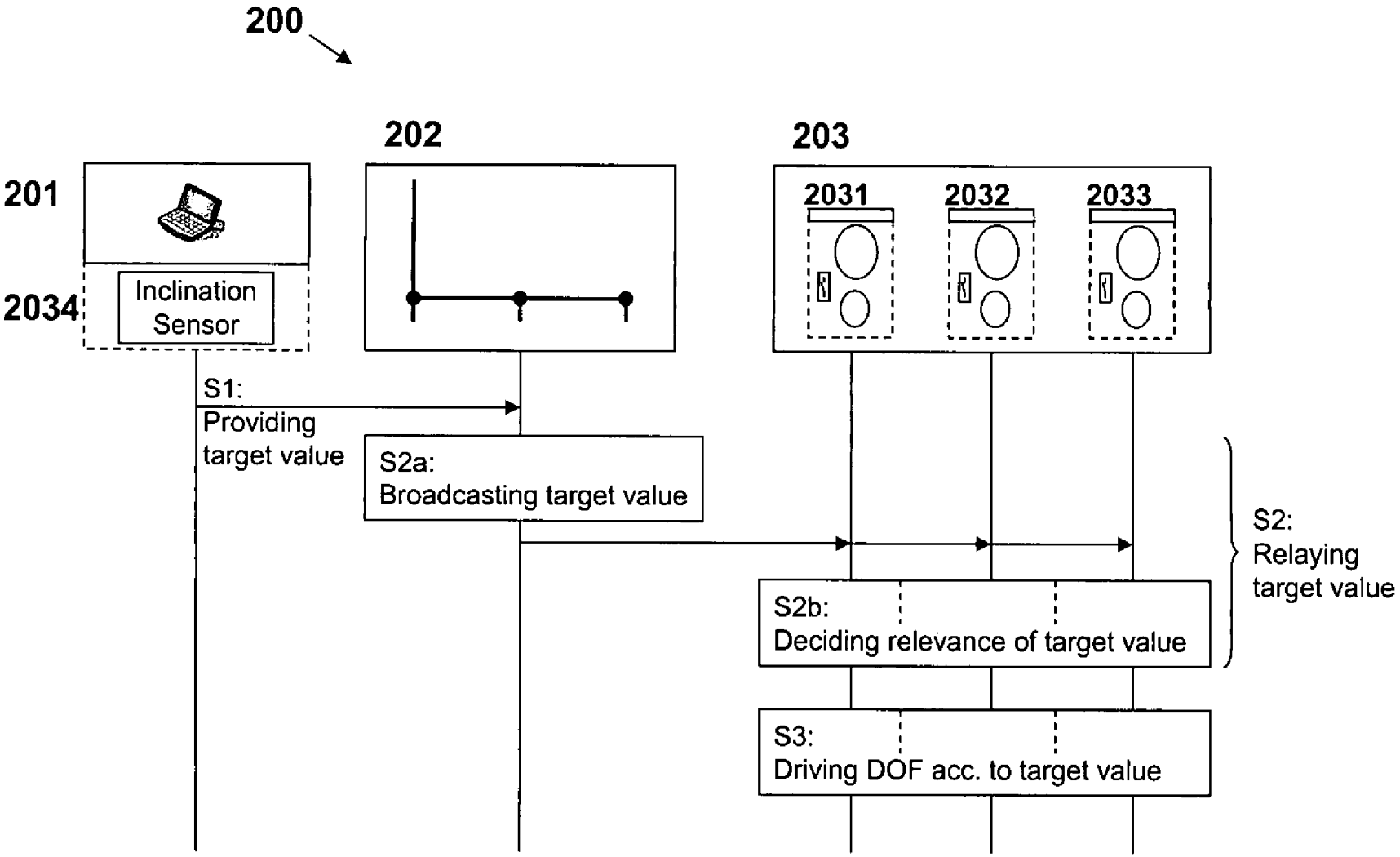
FIG. 3. shows a method for controlling an antenna system according to the present invention.

FIG. 3. shows a method for controlling an antenna system according to the present invention. Signalling between elements is indicated in horizontal direction, while time aspects between signalling are reflected in the vertical arrangement of the signalling sequence as well as in the sequence numbers.

Referring back to FIG. 2, the antenna system 200 comprises the target value provider 201, the inclination sensor 2034, the data-bus 202 and the antenna 203 comprising the antenna drive units 2031 to 2033 including the transceivers **203*x*4**.

In step S1, at least one target value is provided by the target value provider 201 to the data-bus 202. As explained herein above with reference to FIG. 2, the at least one target value may have been calculated in advance based on e.g. the current state or states outputted by the inclination sensor 2034.

In step S2, the at least one target value is relayed to an appropriate one of the antenna drive units 2031 to 2033 for the subsequent driving of one of the DOFs of the antenna 203 by at least one motor 203*x*1.

Preferably, step S2 comprises substeps S2*a* and S2*b*. In substep S2*a*, the at least one target value provided by the target value provider 201 is broadcasted via the data-bus 202 to all devices, units or means connected to the data-bus 202, e.g. at least the transceivers 203*x*4 of the antenna drive units 2031 to 2033. Furthermore, in substep S2*b*, each particular transceiver 203*x*4 decides the relevance of the at least one broadcasted target value in terms of the DOF which is to be driven by the particular motor 203*x*1 associated with the particular transceiver 203*x*4.

In the subsequent step S3, the antenna 203 is driven in the at least one DOF according to the at least one target value provided by the target value provider 201. Preferably, the antenna 203 is only driven by the particular motor or motors 203*s*1 in the DOFs by means of the at least one target value decided to be relevant for driving in the particular DOF.

In the following, with reference to FIGS. 2 and 3, an illustrative example is given for operation of an antenna system 200 according to the present invention, to which the present invention is not to be restricted to.

Assuming a situation in which e.g. a terrestrial antenna 203 is to establish or maintain a given positional relation to e.g. a communication satellite, a need may arise that the antenna has to follow e.g. an arc-like path, while maintaining a given polarization. In that case, e.g. the antenna drive unit 2031 associated with the azimuth DOF and the antenna drive unit 2032 associated with the elevation DOF have to effect driving in the respective DOFs, while the antenna drive unit 2033 associated with the polarization DOF has to maintain the antenna 203 in a constant state in terms of the polarization DOF.

Following the above example, the target value provider 201 calculates target values for the azimuth DOF and the elevation DOF from information on the above arc-like path, the information being e.g. supplied from the inclination sensor 2034 or being stored in advance in the target value provider 201.

Subsequently, the calculated azimuth and elevation target values may be broadcasted over the data-bus 202 e.g. to the antenna drive units. The transceiver 20314 of the antenna azimuth drive unit 2031 can then decide the broadcasted azimuth target values to be relevant, while deciding that the also broadcasted elevation target values are irrelevant. A similar functionality may be performed by the transceiver 2032 of the antenna elevation drive unit 2031, which in turn decides the azimuth/elevation target values to be irrelevant/relevant.

Consequently, the antenna azimuth drive unit 2031 drives the associated motor 20311 based on the azimuth target value, the motor state detected by the positioning sensor 20312 and the current state of the azimuth DOF of the antenna 203 e.g. detected by the inclination sensor 2034. In detail, the positioning sensor may be e.g. a PWM (pulse code modulation) decoder which inputs count pulses incrementally in order to the drive motor 2031 to move. The inclination sensor 2034 could also be considered to supply an actual value in terms of the elevation DOF. The above functionalities may also apply to the antenna polarization drive unit 2033.

Hence, a platform pitch and roll actual value supplied from the inclination sensor 2034 to the target value provider 201, the calculated azimuth/elevation/polarization target value provided by the target value provider 201, and the rotary encoded position of the motor 20311 or 20321 or 20331 are used to conduct a closed-loop control of the motor 20311 and/or 20321 and/or 20331. E.g. as long as a difference between target value and actual value is not zero, the driving in the corresponding DOF is continued. The driving in the corresponding DOF is only stopped if e.g. the above difference becomes zero.

The above closed-loop control for driving the motors may e.g. be effected on a time-triggered basis, i.e. the target value provider 201 releases one target value for each DOF in a given time period.

The present invention can be summarized as follows without being restricted to the details as set out in the following. For example, a CAN-bus is applied for antenna control according to the present invention, thus simplifying the construction of such antennas and saving equipment cost. In principle, the CAN bus is a data-bus connection between various components, and offers the possibility to "program the motors". This programming is used in the present invention to query the current value of respective positioning sensor equipment (e.g. inclination sensor), and to provide a simple to use interface of the motors and sensors to the APS.

The invention claimed is:

1. An antenna system for driving a drivable antenna in at least one movement degree of freedom, comprising:

a target value provider configured to provide at least one target value;

a data-bus configured to relay the at least one target value;

at least one antenna drive unit configured to drive the drivable antenna in the at least one movement degree of freedom according to the at least one target value, and including at least one sensor unit configured to provide a current position in the at least one movement degree of freedom for an internal control of the antenna drive unit, wherein the data-bus is constituted by a Controller Area Network bus, wherein the at least one antenna drive unit is constituted by an integral Controller Area Network bus based motor system, including integrally a transceiver configured to receive the target value relayed by the Controller Area Network bus and to decide the relevance of the target value based on the at least one movement degree of freedom;

one of the at least one sensor unit being a positioning sensor further configured to detect a current motor state based on one of the at least one movement degree of freedom; and a motor configured to drive the antenna in the one of the at least one movement degree of freedom according to the target value received by the transceiver and the current motor state detected by the positioning sensor, and wherein the Controller Area Network bus is connected directly to the target value provider and the transceiver of the at least one integral Controller Area Network bus based motor system.

2. The antenna system according to claim 1, further comprising:

a Controller Area Network bus based inclination sensor for detecting a current inclination of the platform in both a pitch degree of freedom and a roll degree of freedom and broadcasting the current states via the Controller Area Network bus, wherein the target value provider is configured to calculate at least one target value of a movement degree of freedom taking into account the broadcast current states of both the pitch and roll degree of freedom of the platform, and wherein at least one of the at least one antenna drive unit is configured to drive the antenna in the movement degree of freedom internally taking into account the current motor state detected by the positioning sensor to the calculated at least one target value of the movement degree of freedom.

3. An antenna system for driving a drivable antenna in at least one movement degree of freedom, comprising:

first providing means for providing at least one target value;

relaying means for data-bus based relaying the at least one target value;

first driving means for driving the drivable antenna in the at least one movement degree of freedom according to the at least one target value; and second providing means for providing a current position in the at least one movement degree of freedom for an internal control of the driving means, wherein the relaying means is constituted by an integral Controller Area Network bus based motor system, including integrally receiving means for receiving the target value relayed by the relaying means and for deciding the relevance of the target value based on the at least one movement degree of freedom;

detecting means for detecting a current motor state based on one of the at least one movement degree of freedom; and second driving means for driving the antenna in the one of the at least one movement degree of freedom according to the target value received by the receiving means and the current motor state detected by the detecting means, and wherein the relaying means is connected directly to the first providing means and the receiving means.

* * * * *